US006406385B1

(12) United States Patent
Masutani et al.

(10) Patent No.: US 6,406,385 B1
(45) **Date of Patent: *Jun. 18, 2002**

(54) GOLF BALL

(75) Inventors: Yutaka Masutani; Hisashi Yamagishi; Takashi Maruko; Atsushi Nakamura, all of Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 56 days.

This patent is subject to a terminal disclaimer.

(21) Appl. No.: 09/587,806

(22) Filed: Jun. 6, 2000

(30) Foreign Application Priority Data

Jun. 9, 1999 (JP) ..... 11-162109

(51) Int. Cl.[7] ..... A63B 37/04
(52) U.S. Cl. ..... 473/378
(58) Field of Search ..... 473/370, 371, 473/373, 374, 376, 378

(56) References Cited

U.S. PATENT DOCUMENTS 697,925 A * 4/1902 Kempshall ..... 473/373
698,516 A * 4/1902 Kempshall ..... 473/373
720,852 A * 2/1903 Smith ..... 473/374
5,820,485 A 10/1998 Hwang ..... 473/361
5,836,834 A * 11/1998 Masutani et al. ..... 473/374
5,882,567 A 3/1999 Cavallaro et al. ..... 264/255
5,984,807 A * 11/1999 Wai et al. ..... 473/376
6,066,054 A * 5/2000 Masutani ..... 473/374
6,155,935 A * 12/2000 Maruko ..... 473/376
6,267,695 B1 * 7/2001 Masutani ..... 473/377

* cited by examiner

*Primary Examiner*—Mark S. Graham
*Assistant Examiner*—Raeann Gordon
(74) *Attorney, Agent, or Firm*—Sughrue Mion, PLLC

(57) ABSTRACT

A golf ball includes a core, an inner cover formed around the core, and an outer cover formed around the inner cover. A plurality of through-holes are formed in the inner cover, projections are formed on the inner surface of the outer cover at positions corresponding to the through-holes, and the inner cover and the outer cover are joined together in a state in which the projections are received in the through-holes. The ratio a/A between an area a of the core-side end surface of each projection and an area A of the outer-cover-side end surface of the projection falls within the range of 0.04 to 0.80. The ratio s/S between a sum s of the areas A of the outer-cover-side end surfaces of the projections and a surface area S of a virtual spherical surface defined by the outer surface of the inner cover falls within the range of 0.05 to 0.75.

7 Claims, 2 Drawing Sheets

GOLF BALL

BACKGROUND OF THE INVENTION

1. Field of the Invention

The present invention relates to a golf ball having a core, an inner cover formed around the core, and an outer cover formed around the inner cover, and more particularly to a golf ball capable of providing a high trajectory while maintaining high resilience and capable of providing a good hit feel.

2. Description of the Related Art

In general, the launching angle of a golf ball increases with the degree of softness of the golf ball. Therefore, in order to fabricate golf balls which provide a high launching angle and a high trajectory, there has been employed a method in which at least one of the layers of a golf ball is formed of a soft material; e.g., the core is formed of a relatively soft rubber, or one of the inner and outer covers (which may be referred as an intermediate layer and a cover) is formed of a relatively soft resin.

However, in the method in which the core is formed of a relatively soft rubber, when the core is rendered excessively soft, the golf ball becomes so soft that the resilience of the golf ball decreases, resulting in decreased travel distance, although the golf ball can provide a high trajectory. Further, when a player hits such a golf ball with a full shot, the player is given a feel that the ball has no core. Moreover, when the golf ball is hit by use of a putter, the golf ball generates a low-frequency sound, which gives many players an unfavorable impression.

In the method in which either the inner cover or the outer cover is formed of a soft resin, when the resin used to form the soft resin layer is excessively soft or when the soft resin layer is excessively thick, the golf ball becomes so soft that the resilience of the golf ball decreases, resulting in decreased travel distance, although the golf ball can provide a high trajectory. Further, when a player hits such a golf ball with a full shot, the player is given a feel that the ball has no core.

SUMMARY OF THE INVENTION

In view of the foregoing, an object of the present invention is to provide a golf ball which provides a high launch angle while maintaining high resilience and which gives a player who hits the ball with a full shot a feel that the ball has a core.

In order to achieve the above object, the present invention provides a golf ball having a core, an inner cover formed around the core, and an outer cover formed around the inner cover, wherein a plurality of through-holes are formed in the inner cover; projections are formed on the inner surface of the outer cover at positions corresponding to the through-holes; and the inner cover and the outer cover are joined together in a state in which the projections are received in the through-holes. The ratio between an area a of the core-side end surface of each projection and an area A of the outer-cover-side end surface of the projection; i.e., the ratio a/A, falls within the range of 0.04 to 0.80, and the ratio between a sum s of the areas A of the outer-cover-side end surfaces of the projections and a surface area S of a virtual spherical surface defined by the outer surface of the inner cover; i.e., the ratio s/S, falls within the range of 0.05 to 0.75.

In the golf ball of the present invention, when the hardness of the outer cover is rendered greater than that of the inner cover, the projections formed on the harder outer cover enter the softer inner cover, resulting in establishment of a state in which hard portions (projections) are embedded in the softer inner cover (hereinafter, the layer including the inner cover and the projections embedded in the inner cover may be referred to as an "intermediate layer"). By virtue of the above-described structure, the intermediate layer can provide a function as a soft layer (hereinafter referred to as a "soft layer function") and a function as a hard layer (hereinafter referred to as a "hard layer function").

When a player hits the golf ball of the present invention with a full shot by use of, for example, a driver or long iron, a considerably strong external force is applied to the golf ball. In this case, the soft layer function of the intermediate layer attains a high lunching angle and low degree of spin. In addition, the projections produce a reaction force against the external force applied to the golf ball, so that the intermediate layer provides a hard layer function. Therefore, sufficient degree of resilience is obtained, and the player can sense presence of the core.

When a player performs a control shot for the golf ball of the present invention by use of, for example, a middle iron, an external force weaker than that in the case of full shot is applied to the golf ball. In this case, the reaction force generated in the projections becomes weaker as compared with the case of a full shot, so that soft hit feel is obtained. However, since the intermediate layer still retains the hard layer function to a considerable degree, a sufficient degree of resilience is obtained.

When a player performs a control shot for the golf ball of the present invention by use of, for example, a short iron, an external force weaker than that in the case of the control shot by the middle iron is applied to the golf ball. In this case, the reaction force generated in the projections becomes further weaker, so the intermediate layer does not provide the hard layer function. Therefore, soft hit feel and high degree of spin are obtained.

In the golf ball of the present invention, each projection is tapered such that the area of the core-side end surface of each projection is render smaller than that of the area of the outer-cover-side end surface (cross sectional surface) of the projection. Therefore, external force applied to the golf ball is properly received by the projections, so that high degree of resilience can be obtained effectively. Since the tapered shape of the projections decreases the contact area between the core and the projections, and the degree of softness of the inner cover increases toward the center of the golf ball, so that deformation of the projections in the shearing direction (tangential direction) occurs easily. Therefore, when a player takes a shot, such as a shot for applying considerable backspin to the golf ball, in which an external force is applied to the golf ball along the tangential direction, the projections deform easily in the shearing direction, so that soft hit feel and a high degree of spin can be obtained effectively.

As described above, the golf balls of the present invention can provide a high launch angle while maintaining high resilience and can give a player who hits the ball with a full shot a sensation that the ball has a core.

DESCRIPTION OF THE INVENTION

The present invention will now be described in more detail. No particular limitation is imposed on the material of the core, and the material of the core may be a vulcanized rubber containing polybutadiene rubber, polyisoprene rubber, natural rubber, silicone rubber, or any other suitable rubber as a main component. However, a vulcanized rubber containing polybutadiene rubber as a main component is particularly preferred. Deformation of the core upon application of a load of 100 kg is preferably set to the range of 2.0 to 5.0 mm. When the deformation of the core is less than 2.0 mm, the core is excessively hard, so that hit feel may deteriorate. When the deformation of the core is greater than 5.0 mm, the core is excessively soft, so that a desired degree of resilience may not be secured. The core may have a single-layer structure formed of a single type of a material, or a multi-layer structure comprising two or more layers formed of different materials.

No particular limitation is imposed on the material of the inner and outer covers, and known cover materials may be used. Examples of the cover material include ionomer resin, urethane resin, polyester resin, and a mixture of polyurethane resin and polyester resin. Each of the inner and outer layers may have a single-layer structure formed of a single type of a material, or a multi-layer structure comprising two or more layers formed of different materials.

Figure 1:
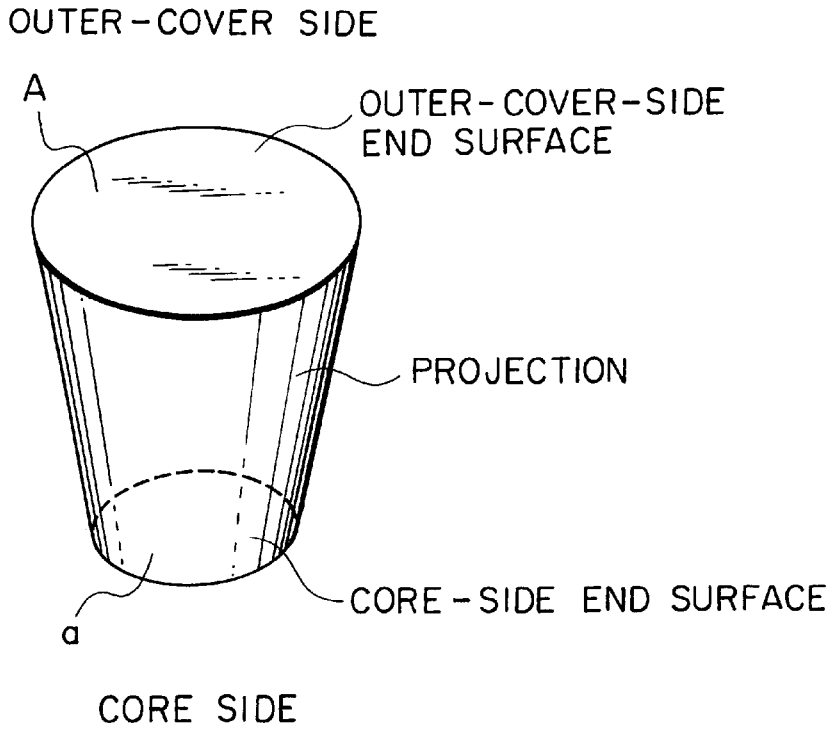
FIG. 1 is a perspective view showing an example of a projection of a golf ball according to the present invention.

In the golf ball of the present invention, a plurality of through-holes are formed in the inner cover; projections are formed on the inner surface of the outer cover at positions corresponding to the through-holes; and the inner cover and the outer cover are joined together in a state in which the projections are received in the through-holes. Each of the projections is tapered down toward the core. That is, as shown in FIG. 1, the ratio a/A between the area a of the core-side end surface of the projection (a curved surface of the projection in contact with the outer surface of the core) and the area A of the outer-cover-side end surface or cross sectional surface of the projection (a curved surface constituting a portion of a virtual spherical surface defined by the outer surface of the inner cover) falls within the range of 0.04 to 0.80. When the ratio is less than 0.04, the projections cannot properly receive external force applied to the ball, resulting in an insufficient degree of resilience. When the ratio exceeds 0.80, the projections become difficult to deform in the shearing direction, resulting in failure to obtain soft hit feel and sufficient degree of spin. The ratio a/A is preferably set to fall within the range of 0.1 to 0.6, more preferably, 0.2 to 0.5. Although the projections may generally have a truncated circular conical shape, a truncated elliptic conical shape, a truncated pyramidal shape, or any other suitable shape, the truncated circular conical shape is particularly preferred.

Further, in the golf ball of the present invention, the ratio s/S between the sum s of the areas A of the outer-cover-side end surfaces of the projections and the surface area S of a virtual spherical surface defined by the outer surface of the inner cover (the outer surface of the inner cover on the assumption that the inner cover has no through-hole) falls within the range of 0.05 to 0.75. When the ratio is less than 0.05, the hard layer function of the intermediate layer becomes insufficient, so that a sufficient degree of resilience is not obtained at the time of a full shot or control shot, and a player cannot sense the presence of the core at the time of the full shot. When the ratio exceeds 0.75, the soft layer function of the intermediate layer becomes insufficient, so that a high launching angle cannot be obtained at the time of the full shot. The ratio s/S is preferably set to fall within the range of 0.1 to 0.6, more preferably, 0.3 to 0.5.

In the golf ball of the present invention, preferably, the shore D hardness of the outer cover is rendered higher than that of the inner cover by 5 or more. When the difference in shore D hardness is less than 5, the inner cover becomes excessively hard or the outer cover becomes excessively soft, or the inner cover becomes excessively soft or the outer cover becomes excessively hard. In either case, the intermediate layer becomes unable to provide both the soft layer function and the hard layer function. The difference in shore D hardness is preferably in the range of 7 to 55, more preferably 12 to 40.

In order to obtain a high trajectory and good hit feel, the shore D hardness of the inner cover is set to fall within the range of 10 to 55, and the shore D hardness of the outer cover is set to fall within the range of 40 to 70.

Further, the ratio a/A is preferably changed with the hardness of the outer cover. Specifically, the ratio a/A and the shore D hardness d of the outer cover preferably satisfy the relationship expressed by the following equation:

$$a/A \leqq -0.025d+1.81. \quad (1)$$

Figure 2:
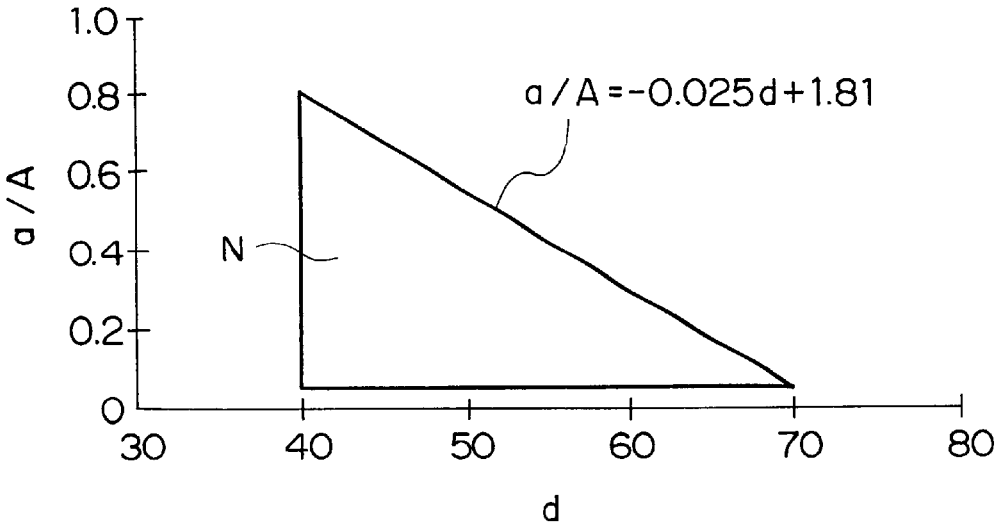
FIG. 2 is a graph showing the relationship between the shore D hardness d of the outer cover and the ratio a/A, where a is the area of the core-side end surface and A is the area of the outer-cover-side end projection.

That is, in the present invention, the ratio a/A and the shore D hardness d of the outer cover are preferably selected within a region N shown in FIG. 2.

In the present invention, the area A of the outer-cover-side end surface of the projection is preferably determined to fall within the range of 1.0 to 50 $mm^2$, more preferably 3.0 to 15 $mm^2$. When the area A is less than 1.0 $mm^2$, the rigidity of the projection becomes insufficient. When the area A exceeds 50 $mm^2$, the softness of the intermediate layer is impaired.

In the present invention, the number of the projections is preferably set to fall within the range of 50 to 500, more preferably 100 to 300. When the number of the projections is less than 50, the density of the projections becomes excessively low, so that the effect of the projections becomes uneven. When the number of the projections exceeds 500, the density of the projections becomes excessively high, so that the softness of the intermediate layer is impaired.

The thickness of the outer cover at portions where the projections are not formed preferably falls within the range of 0.5 to 4.0 mm, more preferably 1.0 to 2.0 mm, and the thickness of the inner cover preferably falls within the range of 0.5 to 4.0 mm, more preferably 1.0 to 2.0 mm. However, the thicknesses of the inner and outer covers are not limited to these ranges.

In the present invention, each of the projections is preferably formed substantially along the direction of a normal line of the golf ball, so that the projections properly produce reaction force against external force acting on the golf ball, and the golf ball has excellent symmetry. The term "normal line" means a straight line which passes through a certain point P on the surface of the golf ball and is perpendicular to a tangent plane at the point P. The normal line corresponds to a line (radial line) connecting the point P and the center of the golf ball. Therefore, the projection—which is formed substantially along the direction of a normal line—is a projection whose axis extends substantially along a corresponding radial line of the golf ball.

In compliance with golf rules, the golf ball is formed such that the golf ball has a diameter of 42.67 mm or greater and a weight of 45.93 g or less.

DESCRIPTION OF THE PREFERRED EMBODIMENT

Figure 3:
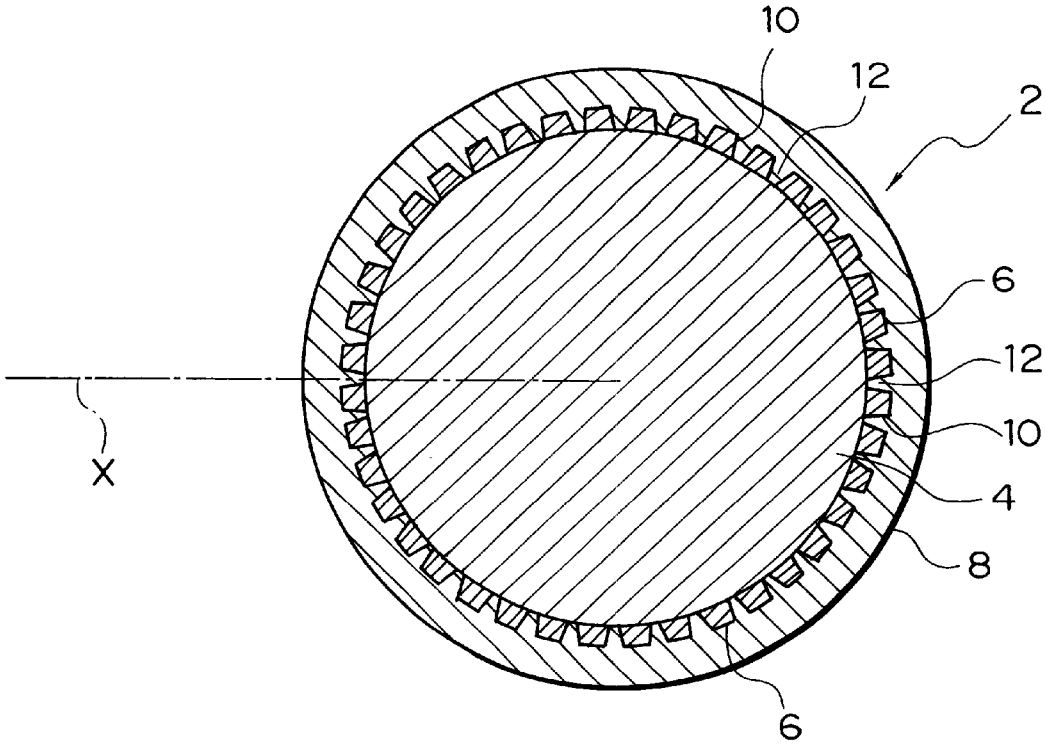
FIG. 3 is a sectional view showing an embodiment of the golf ball according to the present invention.

FIG. 3 is a cross-sectional view showing an embodiment of the golf ball according to the present invention. The golf ball 2 shown in FIG. 3 is a multi-piece solid golf ball having three layers; i.e., a core 4, an inner cover 6 formed around the core 4 and having a lower hardness, and an outer cover 8 formed around the inner cover 6 and having a higher hardness. An amount of deformation of the core 4 upon application of a 100 kg load falls within the range of 2.0 to 5.0 mm. The inner cover 6 is formed of a resin having a shore D hardness of 10 to 55, and the outer cover 8 is formed of a resin having a shore D hardness of 40 to 70. The shore D hardness of the outer cover 8 is higher than that of the inner cover 6 by 5 or more.

In the golf ball 2 of the present embodiment, a large number of through-holes 10 are formed in the inner cover 6; projections 12 are formed on the inner surface of the outer cover 8 at positions corresponding to the through-holes 10; and the inner cover 6 and the outer cover 8 are joined together in a state in which the projections 12 are received in the through-holes 10. Each of the projections 12 generally has a truncated circular conical shape whose axis extends along a normal direction X. The ratio a/A (FIG. 1) between the area a of the core-side end surface of the projection and the area A of the outer-cover-side end surface of the projection falls within the range of 0.04 to 0.80. The ratio s/S between the sum s of the areas A of the outer-cover-side end surfaces (cross sectional surfaces) of the projections and the surface area S of a virtual spherical surface defined by the outer surface of the inner cover 6 falls within the range of 0.05 to 0.75. Further, the ratio a/A and the shore D hardness d of the outer cover 8 satisfy the relationship expressed by the above-described equation (1). Moreover, the area A of the outer-cover-side end surface of the projection 12 falls within the range of 1 to 50 $mm^2$, and the number of the projections falls within the range of 50 to 500.

The golf ball 2 of the present embodiment can be fabricated in accordance with the following exemplary steps; however, the fabrication method of the golf ball 2 is not limited thereto.

(1) After the core 4 is formed from a vulcanize rubber through compression molding, the inner cover 6 having a large number of the through-holes 10 is formed around the core 4. The formation of the inner cover 6 may be performed by a method in which the inner cover 6 is injection-molded around the core 4 by use of a mold having on its cavity surface a large number of projections for forming a large number of through-holes, or a method in which two semi-spherical cup members having a large number of the through-hole 10 are fabricated through injection molding or compression molding, and the two semi-spherical cup members are joined to the outer surface of the core 4 through compression molding or any other suitable manner in order to form the inner cover 6 around the core 4.

(2) The outer cover 8 is formed around the inner cover 6 through injection molding, during which dimples are formed in the outer cover 8. In this case, the interior of the mold is evacuated by use of a vacuum pump in order to create a negative pressure therein to thereby enable the resin of the outer cover 8 to flow sufficiently into the through-holes 10.

EXAMPLES

Golf balls of Examples 1 and 2 and Comparative Examples 1–5 shown in Table 1 were manufactured. Among the components used in the examples and shown in Table 1, the base rubber was a mixture of polybutadiene rubbers JSR-BR01 and JSR-BR11 (products of JSR corporation; weight ratio: 50:50); the vulcanizing agent was dicumyl peroxide (Percumyl D, product of NOF corporation); and the curing agent was zinc acrylate. The polyester used for the inner cover was Hytrel H4047 (product of Toray DuPont); and the ionomer B used for the inner cover was a mixture of Surlyn 8120 (product of DuPont) and Himilan 1855 (product of DuPont Mitsui Polychemicals) (weight ratio: 65:35). The ionomer A used for the outer cover was a mixture of Himilan 1605 and Himilan 1706 (products of DuPont Mitsui Polychemicals) (weight ratio: 50:50). The ball hardness shown in Table 1 represents an amount of deformation of a golf ball under a load of 100 kg. The length ratio of the projection shown in Table 1 represents the ratio of the length of the projection along the normal direction to the thickness of the inner cover at portions in which no through-holes are formed.

TABLE 1

| | Examples | | Comparative Examples | | | | |
|---|---|---|---|---|---|---|---|
| | 1 | 2 | 1 | 2 | 3 | 4 | 5 |
| Ball configuration | 3 layers | 3 layers | 3 layers | 3 layers | 3 layers | 3 layers | 3 layers |
| Core composition (parts by weight) | | | | | | | |
| Base rubber | 100 | 100 | 100 | 100 | 100 | 100 | 100 |
| Zinc oxide | 30 | 30 | 30 | 30 | 30 | 30 | 30 |
| Vulcanizing agent | 1.2 | 1.2 | 1.2 | 1.2 | 1.2 | 1.2 | 1.2 |
| Curing agent | 18 | 18 | 18 | 18 | 18 | 18 | 18 |
| Core weight (g) | 29.2 | 29.0 | 29.2 | 29.1 | 29.0 | 29.0 | 29.0 |
| Inner cover | | | | | | | |
| Composition | Polyester | Ionomer B | Polyester | Ionomer B | Polyester | Polyester | Polyester |
| Thickness (mm)*1 | 2.0 | 2.0 | 1.7 | 2.0 | 2.0 | 2.0 | 1.9 |
| Hardness (shore D) | 40 | 51 | 40 | 51 | 40 | 40 | 40 |
| Outer cover | | | | | | | |
| Composition | Ionomer A | Ionomer A | Ionomer A | Ionomer A | Ionomer A | Ionomer A | Ionomer A |
| Hardness (shore D) | 63 | 63 | 63 | 63 | 63 | 63 | 63 |

TABLE 1-continued

| | Examples | | Comparative Examples | | | | |
|---|---|---|---|---|---|---|---|
| | 1 | 2 | 1 | 2 | 3 | 4 | 5 |
| Projections | | | | | | | |
| Shape | Truncated cone | Truncated cone | Cylinder | Cone | Truncated cone | Truncated cone | Truncated cone |
| Length ratio (%)*2 | 100 | 100 | 100 | 100 | 100 | 100 | 70 |
| a/A | 0.2 | 0.4 | 1 | 0 | 0.9 | 0.4 | 0.5 |
| s/S | 0.6 | 0.3 | 0.3 | 0.6 | 0.6 | 0.8 | 0.5 |
| Golf ball | | | | | | | |
| Diameter (mm) | 42.70 | 42.75 | 42.72 | 42.69 | 42.72 | 42.73 | 42.70 |
| Weight (g) | 45.28 | 45.30 | 45.40 | 45.30 | 45.25 | 45.36 | 45.30 |
| Hardness (mm)*3 | 3.02 | 2.79 | 3.00 | 2.80 | 3.10 | 3.12 | 3.04 |
| Travel performance test | | | | | | | |
| Initial speed (m/s) | | | | | | | |
| W1: HS45 | 76.98 | 77.09 | 77.00 | 77.10 | 77.03 | 76.92 | 76.86 |
| Spin (rpm) | | | | | | | |
| W1: HS45 | 2275 | 2320 | 2599 | 2623 | 2478 | 2521 | 2568 |
| I5: HS40 | 4953 | 5025 | 4931 | 4939 | 4912 | 4895 | 4958 |
| SW: HS:25 | 4589 | 4697 | 4580 | 4516 | 4489 | 4412 | 4427 |
| Travel distance (mm) | | | | | | | |
| W1: HS45 | | | | | | | |
| Carry | 214.9 | 215.6 | 214.7 | 213.3 | 214.0 | 213.1 | 213.8 |
| Total | 223.5 | 221.4 | 220.2 | 220.8 | 218.0 | 218.3 | 217.3 |

*1: Thickness at portions where no through-holes are formed.
*2: (Length of projections alone the normal direction/Thickness of the inner cover at portions in which no through-holes are formed)/100
*3: Deformation of a ball under 100 kg load.

For the golf balls of Examples and Comparative Examples, a travel performance test was performed in accordance with the method described below.

Travel performance test:

The following values were measured by use of a hitting test machine.

(1) Each golf ball was hit by use of a driver (W#1) at a head speed of 45 m/s (HS45), and initial speed, spin, and travel distance were measured.

(2) Each golf ball was hit by use of an iron No. 5 (I#5) at a head speed of 40 m/s (HS40), and spin was measured.

(3) Each golf ball was hit by use of a sand wedge (SW) at a head speed of 25 m/s (HS25), and spin was measured.

Test results are shown in Table 1 . As is apparent from Table 1 , the golf balls of Examples 1 and 2 ; i.e., the golf balls of the present invention, produce a decreased degree of spin (low spin characteristic) upon being hit by use of the driver, and are excellent in terms of both of carry travel distance and total travel distance, as compared with the golf balls of the Comparative Examples that do not satisfy the requirements of the present invention; i.e., the golf ball of Comparative Example 1 in which the ratio a/A is 1, the golf ball of Comparative Example 2 in which the ratio a/A is 0, the golf ball of Comparative Example 3 in which the ratio a/A is 0.9, the golf ball of Comparative Example 4 in which the ratio s/S is 0.8, and the golf ball of Comparative Example 5 in which the holes formed in the inner cover are not through-holes. Further, upon being hit by use of the iron No. 5 or the sand wedge, the golf balls of the present invention produce an increased degree or the same degree of spin as compared with the golf balls of the Comparative Examples.

What is claimed is:

1. A golf ball having a core, an inner cover formed around the core, and an outer cover formed around the inner cover, wherein a plurality of through-holes are formed in the inner cover; projections are formed on the inner surface of the outer cover at positions corresponding to the through-holes; and the inner cover and the outer cover are joined together in a state in which the projections are received in the through-holes, and wherein the ratio a/A between an area a of the core-side end surface of each projection and an area A of the outer-cover-side end surface of the projection falls within the range of 0.04 to 0.80, and the ratio s/S between a sum s of the areas A of the outer-cover-side end surfaces of the projections and a surface area S of a virtual spherical surface defined by the outer surface of the inner cover falls within the range of 0.05 to 0.75.

2. A golf ball according to claim 1, wherein the shore D hardness of the outer cover is higher than that of the inner cover by 5 or more.

3. A golf ball according to claim 1, wherein the shore D hardness of the inner cover falls within the range of 10 to 40, and the shore D hardness of the outer cover falls within the range of 40 to 70.

4. A golf ball according to claim 1, wherein the ratio a/A and the shore D hardness d of the outer cover satisfy the relationship expressed by the following equation:

$$a/A \leqq -0.025d+1.81. \quad (1)$$

5. A golf ball according to claim 1, wherein the area A of the outer-cover-side end surface of the projection falls within the range of 1.0 to 50 $mm^2$.

6. A golf ball according to claim 1, wherein the number of the projections falls within the range of 50 to 500.

7. A golf ball according to claim 1, wherein deformation of the core upon application of a load of 100 kg falls with the range of 2.0 to 5.0 mm.

* * * * *